US006573648B1

(12) United States Patent
Usami

(10) Patent No.: US 6,573,648 B1
(45) Date of Patent: Jun. 3, 2003

(54) DEFLECTION YOKE WITH OPENINGS IN NECK BEND SECTION

(75) Inventor: Yoshihiko Usami, Greensburg, PA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/443,657

(22) Filed: Nov. 19, 1999

(51) Int. Cl.[7] ..... H01J 29/76
(52) U.S. Cl. ..... 313/440; 335/213
(58) Field of Search ..... 313/440, 431; 335/210, 213

(56) References Cited

U.S. PATENT DOCUMENTS 5,142,205 A 8/1992 Yabase et al. ..... 315/368.26
5,838,099 A 11/1998 Hichiwa et al. ..... 313/440

*Primary Examiner*—Michael H. Day
(74) *Attorney, Agent, or Firm*—Mayer Fortkort & Williams, PC; Michael P. Fortkort

(57) ABSTRACT

A deflection yoke for deflecting electron beams of a color cathode ray tube includes a saddle type horizontal deflection coil, which has a front bend section and a neck bend section. The neck bend section includes a pair of openings in the winding distribution. Each of the openings is disposed at a disposition angle relative to a horizontal axis through the neck bend section of approximately ten degrees and at a predetermined distance from a center of the neck bend section within a range from approximately three millimeters to approximately fifteen millimeters. Each of the openings has a substantially triangular shape, trapezoidal or semicircular shape. A resulting XH and HCR mis-convergence curve of the deflection yoke of the present invention passes through the origin, thereby making it possible to simultaneously correct both XH and HCR mis-convergence to zero.

15 Claims, 6 Drawing Sheets

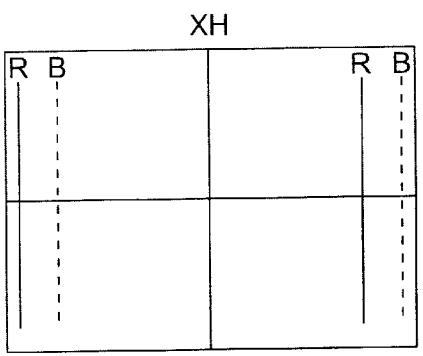
FIG. 1A
(PRIOR ART)
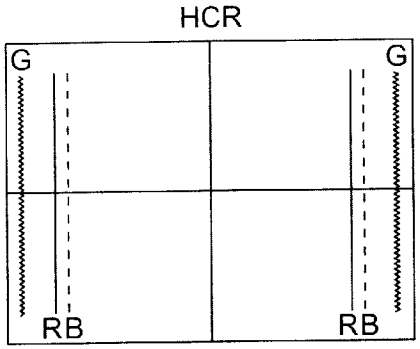
FIG. 1B
(PRIOR ART)
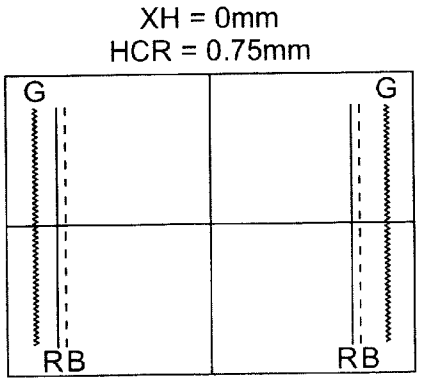
FIG. 2A
(PRIOR ART)
FIG. 2B
(PRIOR ART)
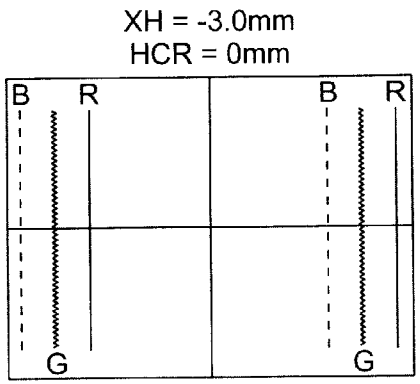
FIG. 2C
(PRIOR ART)

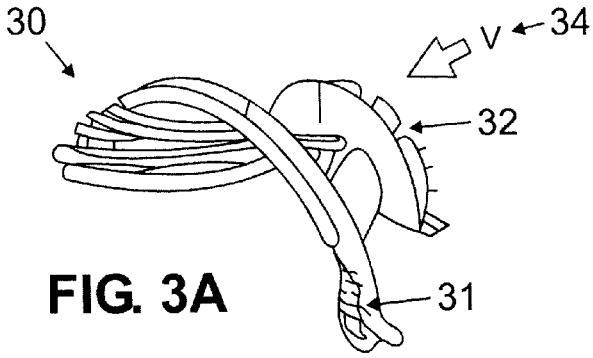
FIG. 3A
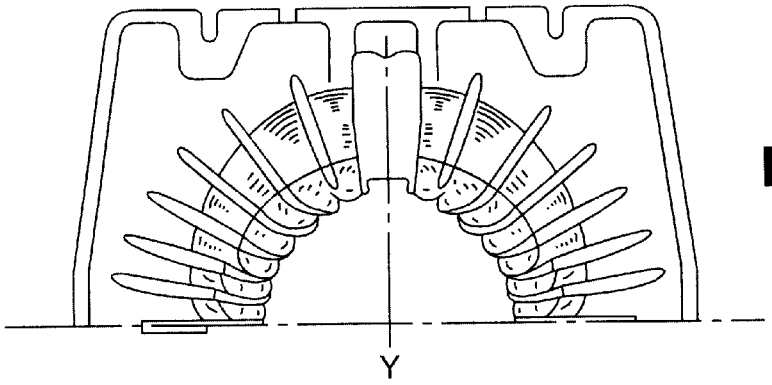
CONVENTIONAL
FIG. 3B
FIG. 3C
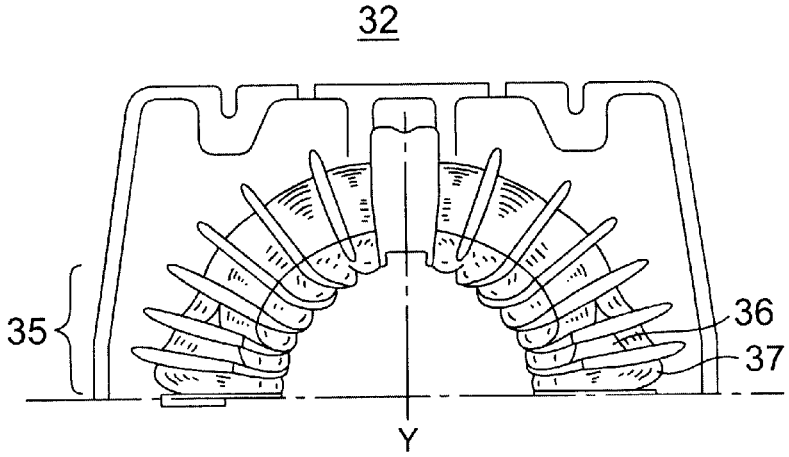

DEFLECTION YOKE WITH OPENINGS IN NECK BEND SECTION

BACKGROUND OF THE INVENTION

The present invention relates generally cathode ray tubes, and more particularly to a cathode ray tube including a saddle type of horizontal coil used in a deflection yoke.

An important aspect of performance for a television monitor is its ability to correctly align the individual color components (red, green and blue). Convergence describes how far apart the three electron beams spread from one another within a pixel. Ideally, the beam hits all three dots in the group without hitting any adjacent groups. Mis-convergence is a quantitative measurement of the lack of convergence of the three electron beams. The resulting image will have a shadowed appearance in case of mis-convergence.

A deflection yoke is used to control the convergence of the three electron beams (red, green and blue) in a cathode ray tube (CRT) by changing the winding distribution in the horizontal and vertical coils to compensate for mis-convergence. For example, U.S. Pat. No. 5,838,099 discloses one such deflection yoke, which can be seen in FIG. 7, which depicts a perspective view showing a pair of saddle type horizontal deflection coils.

Referring to FIGS. 1A and 1B, depicted therein are two possible patterns of mis-convergence. In FIG. 1A, the mis-convergence is referred to as XH mis-convergence, whereas in FIG. 1B, the mis-convergence is referred to as HCR mis-convergence. In XH mis-convergence, the plus patterns of the red (R) and blue (B) lines fail to converge. In HCR mis-convergence, the plus patterns of the green (G) lines fail to converge with the plus patterns of the red (R) and blue (B) converged lines.

The trend in cathode ray tubes is towards larger and flatter screens. As the screen in a CRT becomes larger and flatter it becomes more difficult to adjust the mis-convergence using conventional methods.

FIG. 2A depicts a cathode ray tube exhibiting both XH and HCR mis-convergence. Note that the red (R) and blue (B) plus patterns fail to converge by about 1.0 mm and the green (G) plus patterns fail to converge with the red (R) and blue (B) plus patterns by a similar amount.

Correcting only the XH mis-convergence so that the XH mis-convergence becomes zero, results in an HCR mis-convergence of about 0.75 mm, as depicted in FIG. 2B. Alternatively, correcting the HCR mis-convergence until it becomes zero results in an over-correction of the XH mis-convergence to result in an XH mis-convergence of about −3.0 mm., as depicted in FIG. 2C. The end result is that using conventional attempts to correct XH and HCR mis-convergence simultaneously is difficult due to the sensitivity of the winding distribution between XH and HCR mis-convergence.

One attempt to correct both of these phenomena requires extra corrective parts on the distribution yoke. For example, U.S. Pat. No. 5,142,205 discloses a deflection yoke having a correction circuit for correcting horizontal and vertical mis-convergence. This technique requires additional electronic components, thereby increasing the parts and assembly costs of the CRT and as well as increasing the overall dimensions of the resulting device.

Alternatively, the horizontal coil can be re-manufactured in an attempt to simultaneously reduce the mis-convergence phenomena. However, this becomes difficult in a fast assembly process.

The present invention is therefore directed to the problem of developing a method and apparatus for adjusting XH and HCR mis-convergence in a cathode ray tube, which method and apparatus can be employed in larger and flatter CRT screens without increasing the costs or size of the device.

SUMMARY OF THE INVENTION

The present invention solves this problem by providing a triangular cutout portion in the winding distribution disposed at a disposition angle of approximately 10 degrees relative to a horizontal axis and having a base ranging from approximately 3–15 mm.

According to one aspect of the present invention, a deflection yoke for deflecting electron beams of a color cathode ray tube includes a saddle type horizontal deflection coil, which has a front bend section and a neck bend section. The neck bend section includes a pair of openings in the winding distribution. Each of the openings is disposed at a disposition angle relative to a horizontal axis through the neck bend section of approximately ten degrees and at a predetermined distance from a center of the neck bend section.

According to another aspect of the present invention, in the above deflection yoke the predetermined distance falls within a range from approximately three millimeters to approximately fifteen millimeters.

According to another aspect of the present invention, in the above deflection yoke each of the openings has a base that lies on the disposition angle.

According to yet another aspect of the present invention, in the above deflection yoke each of the openings has a substantially triangular shape.

According to yet another aspect of the present invention, in an alternative embodiment of the above deflection yoke each of the openings has a substantially trapezoidal shape.

According to yet another aspect of the present invention, in an alternative embodiment of the above deflection yoke each of the openings has a substantially semicircular shape.

According to another aspect of the present invention, a method for simultaneously correcting XH and HCR mis-convergence in a deflection yoke of a cathode ray tube, which deflection yoke has a horizontal coil that includes, a front bend section and a neck bend section, includes three steps. First, a pair of voids is created in a winding distribution in the neck bend section of the horizontal coil. Second, the pair of voids are disposed at a disposition angle of approximately ten degrees, wherein the disposition angle is defined relative to a horizontal axis through the neck bend section of the horizontal coil. Third, a width of each of the voids is adjusted so that a resulting XH and HCR mis-convergence curve passes through the origin.

According to another aspect of the present invention, in the above method the width of each of the voids is adjusted within a range from approximately three millimeters to approximately fifteen millimeters.

According to yet another aspect of the present invention, in the above method each of the voids is disposed so that their base lies on the disposition angle.

According to another aspect of the present invention, in the above method each of the voids is created with a substantially triangular shape.

According to yet another aspect of the present invention, in an alternative embodiment of the above method each of the voids is created with a substantially trapezoidal shape.

According to yet another aspect of the present invention, in an alternative embodiment of the above method each of the voids is created with a substantially semicircular shape.

According to another aspect of the present invention, a device for self-correcting mis-convergence of electron beams of a color cathode ray tube includes a horizontal coil with a neck bend section.and a front bend section. The neck bend section has a winding distribution symmetric about a horizontal axis. In addition, the device includes a means for simultaneously correcting XH and HCR misconvergence. The correcting means is disposed in the neck bend section and creates a XH-HCR misconvergence curve for the device that passes through the origin.

According to another aspect of the present invention, in the above device the correcting means includes a pair of openings in the winding distribution of the horizontal coil.

According to another aspect of the present invention, in the above device each of the openings is disposed at a disposition angle relative to the horizontal axis through the neck bend section of approximately ten degrees.

According to another aspect of the present invention, in the above device each of the openings is disposed at a predetermined distance from a center of the neck bend section.

According to another aspect of the present invention, in the above device the predetermined distance falls within a range from approximately three millimeters to approximately fifteen millimeters.

According to another aspect of the present invention, in the above device each of the openings has a base that lies on the disposition angle.

According to another aspect of the present invention, in the above device each of the openings has a substantially triangular shape.

According to yet another aspect of the present invention, in an alternative embodiment of the above device each of the openings has a substantially trapezoidal shape.

According to yet another aspect of the present invention, in an alternative emodiment of the above device each of the openings has a substantially semicircular shape.

BRIEF DESCRIPTION OF THE DRAWINGS

FIGS. 1A–B depict two possible patterns of mis-convergence, which the present invention seeks to correct simultaneously, in which FIG. 1A depicts XH mis-convergence and FIG. 1B depicts HCR mis-convergence.

FIG. 2A depicts a sample screen in which the XH mis-convergence is 1.0 mm, and the HCR mis-convergence is 1.0 mm.

FIG. 2B depicts a result of a conventional correction of the XH mis-convergence, which is reduced to 0.0 mm, but the HCR mis-convergence is only reduced to 0.75 mm.

FIG. 2C depicts a result of a conventional correction of the HCR mis-convergence, which is reduced to 0.0 mm, but the XH mis-convergence is over-corrected to −3.0 mm.

FIG. 3A depicts an exemplary embodiment of a deflection yoke according to the present invention.

FIG. 3B depicts a conventional shape of the neck bend of a deflection yoke as viewed in the vertical direction.

FIG. 3C depicts an exemplary embodiment of a neck bend of a deflection yoke according to the present invention as viewed in the V direction as defined in FIG. 3A.

DETAILED DESCRIPTION

Figure 4A:
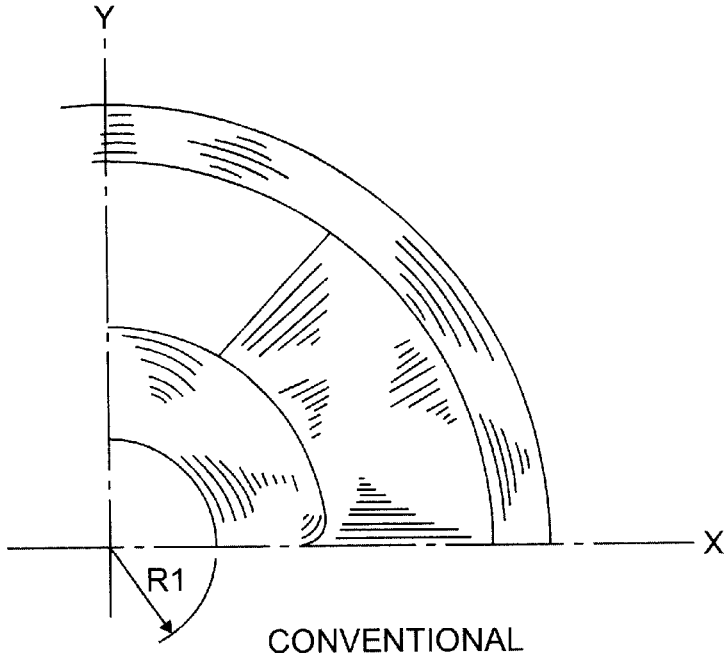
FIG. 4A depicts a detailed view of the conventional neck bend of FIG. 3B.

FIG. 3A depicts an exemplary embodiment of the present invention for the horizontal coil 30. The horizontal coil includes a front-bend section 31 and a neck-bend section 32. The present invention is directed to the small half circle portion of the horizontal coil, often referred to as the neck bend 32.

FIG. 3B depicts a shape of a conventional neck bend 33. In contrast, FIG. 3C depicts an exemplary embodiment of a neck bend 32 according to the present invention. Both of the views in FIGS. 3B and 3C are as seen from the V direction 34, as defined in FIG. 3A.

As can be seen in FIG. 3C, the neck bend section 32 of the present invention deviates from the conventional design in the area marked 35, which is symmetrical with respect to the y-axis, i.e., a similar section occurs on the other side. The y-axis is the horizontal axis that passes through the neck bend section 32 of the horizontal coil 30. The section 35 includes a small cutout portion 36 having a substantially triangular shape. This triangular cutout portion is a section where a void in the winding distribution is provided. The cutout portion or opening can have a substantially trapezoidal shape as well as a substantially semicircular shape.

Figure 4B:
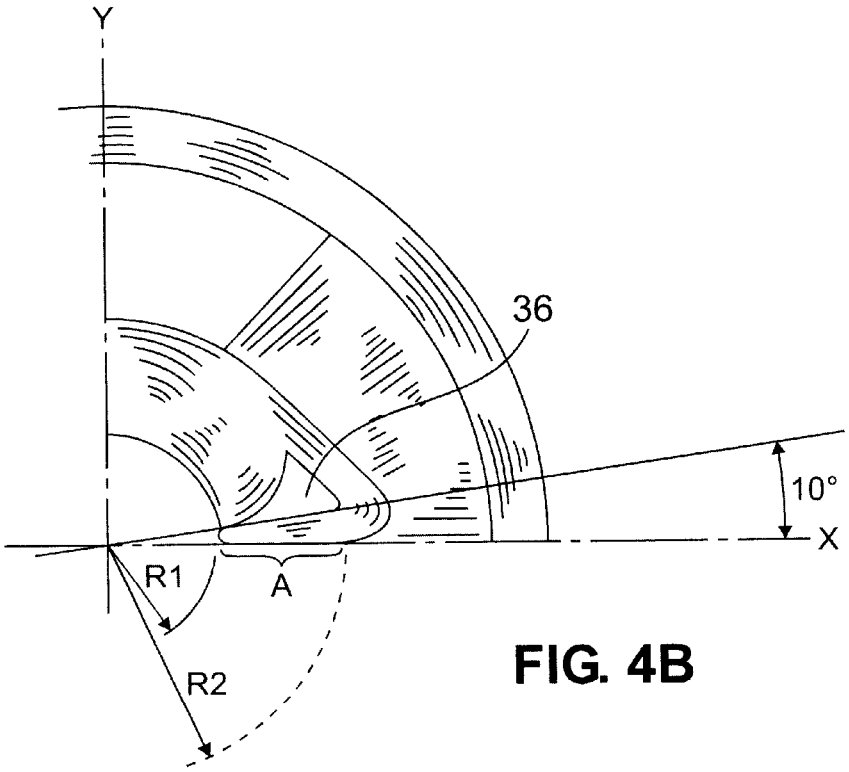
FIG. 4B depicts a detailed view of the neck bend of FIG. 3C according to the present invention.

Referring to FIGS. 4A and 4B, a blow-up of one-half of the views in FIGS. 3A and 3B are shown. In the conventional design, as depicted in FIG. 4A, the winding distribution has an inner radius R1. According to one aspect of the present invention, as depicted in FIG. 4B, a base of the triangular cutout portion 36 begins at the inner radius R1 and ends at a second radius R2. In addition, the triangular cutout portion is disposed at an angle (referred herein to as the disposition angle) of approximately 10 degrees above the x-axis. In each of the above mentioned alternative embodiments of the cutout portion or void, i.e., the trapezoidal or semicircular shapes, the base of the shape lies on the disposition angle, and has a width A selected to make the XH and HCR mis-convergence both zero, as will be seen below.

According to one aspect of the present invention, the neck bend 32 inner radius R2 must be larger than the inner radius R1 by at least approximately 3 mm., but less than approximately 15 mm. In other words, the with of the base of the triangular cutout portion can range from approximately 3–15 mm. The same is true for the alternative shapes of the openings.

According to another aspect of the present invention, the neck bend inner diameter disposition angle should be less than approximately 10 degrees, as measured from the horizontal axis (the x-axis in FIG. 4B) that passes through the neck bend section 32.

Figure 5A:
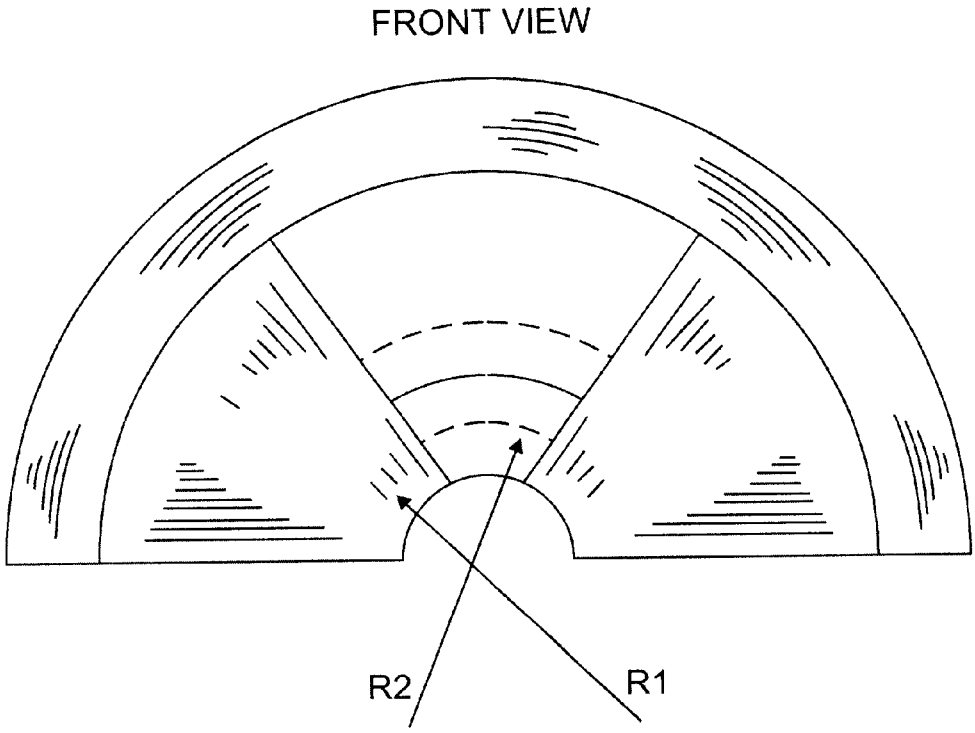
FIG. 5A depicts a front view of an exemplary embodiment of a neck bend according to the present invention.

Referring to FIG. 5A, shown therein is a front view of an exemplary embodiment of a neck bend 32 according to the present invention showing the relationship between the inner radius R1 and the outer radius R2 of the opening 36.

Figure 5B:
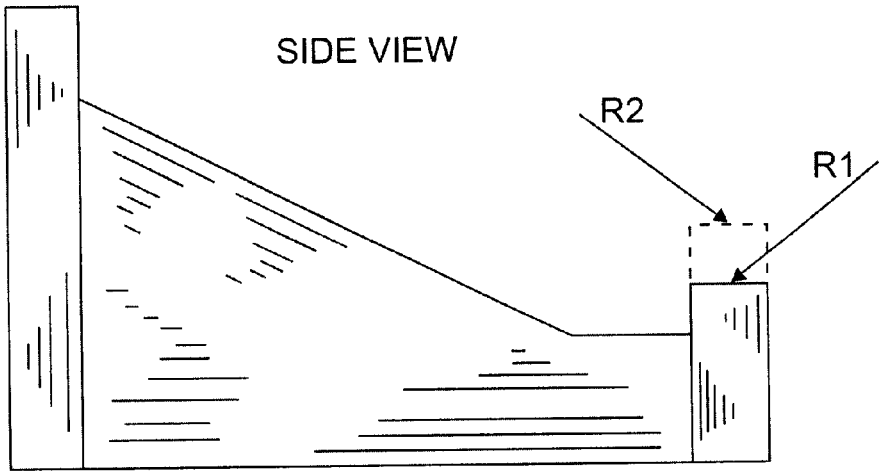
FIG. 5B depicts a side view of an exemplary embodiment of a neck bend according to the present invention.
Figure 5C:
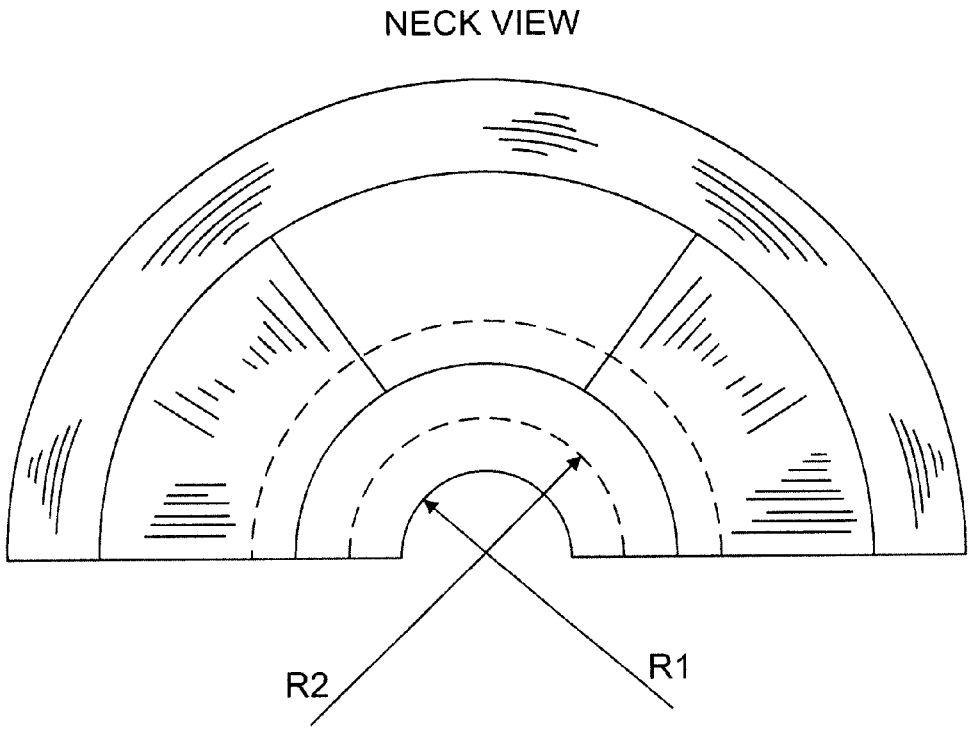
FIG. 5C depicts a neck view of an exemplary embodiment of a neck bend according to the present invention.

Referring to FIG. 5B, shown therein is a side view of an exemplary embodiment of a neck bend 32 according to the present invention showing the relationship between the inner radius R1 and the outer radius R2 of the opening 36. Referring to FIG. 5C, shown therein is a neck view of an exemplary embodiment of a neck bend according to the present invention showing the relationship between the inner radius R1 and the outer radius R2 of the opening 36.

Figure 6A:
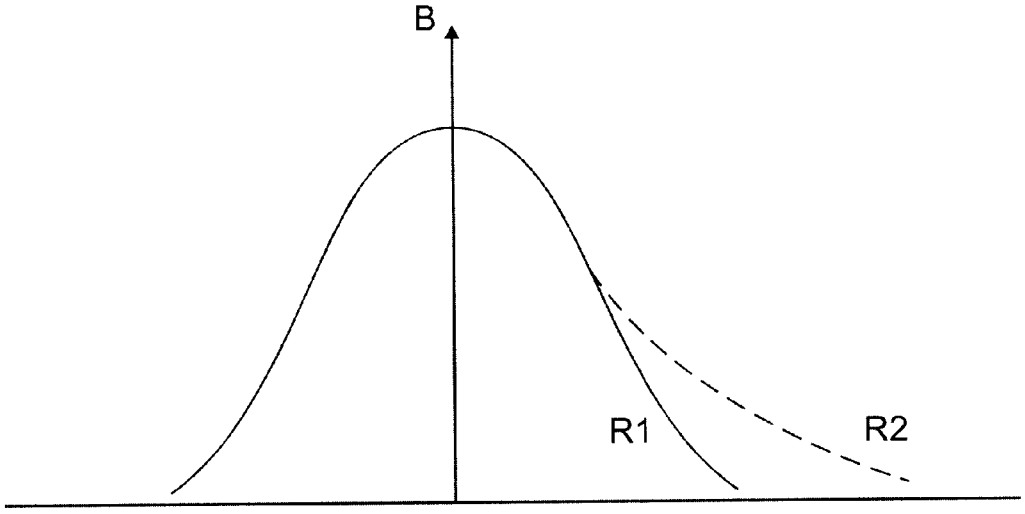
FIG. 6A depicts the magnetic flux density of the horizontal coil for R1 and R2 according to the present invention.

To correct both the XH and HCR mis-convergence simultaneously, the front bend section 31 and the neck bend section 32 of the horizontal coil 30 reduce the flux leaking from the horizontal coil 30. FIG. 6A depicts the magnetic flux density of the horizontal coil 30 for both the conventional design (the curve for which is labeled as R1) and an exemplary embodiment of the present invention (the curve for which is labeled as R2). As seen therein, the magnetic flux density of the exemplary embodiment of the present invention tails off slower than the conventional design. As a result of the triangular cutout portions 36, the flux distribution is changed in this manner. The segment of the coil without the cutout portion shown in FIG. 4B results in a magnetic field about that area that is too strong, which affects mainly the HCR. By providing this triangular cutout portion, the XH and HCR values are balanced and can be simultaneously corrected to zero.

Figure 6B:
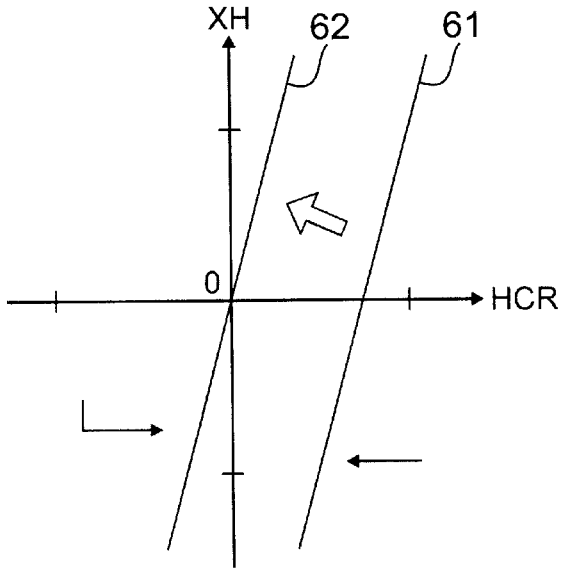
FIG. 6B depicts the resulting the XH-mis-convergence and HCR mis-convergence for both the conventional design and the exemplary embodiment of the present invention.
Figure 7:
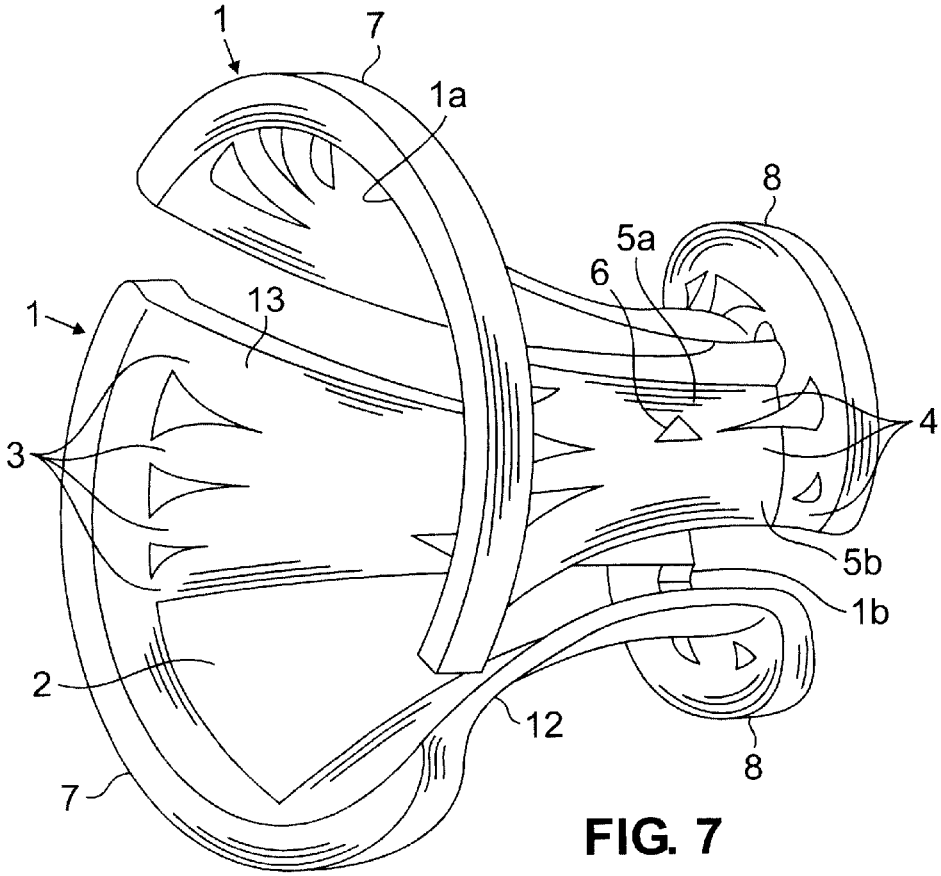
FIG. 7 (PRIOR ART)
FIG. 7 depicts a perspective view showing a pair of prior art saddle type horizontal deflection coils.

The end result of this balancing is depicted in FIG. 6B. The conventional coil has a curve 61 of XH and HCR that does not pass through the origin, which means that it is not possible to correct both XH and HCR to zero. In other words, correcting one type of mis-convergence to zero always will result in the other type of mis-convergence being non-zero. In contrast, the exemplary embodiment of the present invention has a resulting XH and HCR curve 62 that passes through the origin, showing it is possible to reduce the XH and HCR to zero simultaneously due to the present invention. To simultaneously correct both types of mis-convergence, the width of the opening is adjusted.

Thus, the present invention reduces the cost and time of redesign of the horizontal coil to correct for both types of mis-convergence. Moreover, the adjustment value is flexible by the neck bend inner (R1) and outer radius (R2) and disposition angle.

What is claimed is:

1. A deflection yoke for deflecting electron beams of a color cathode ray tube comprising a saddle type horizontal deflection coil having a front bend section and a neck bend section, the neck bend section including a pair of openings in the winding distribution, each of the openings being disposed at a disposition angle relative to a horizontal axis through the neck bend section of approximately ten degrees and at a predetermined distance from a center of the neck bend section.

2. The deflection yoke according to claim 1, wherein the predetermined distance falls within a range from approximately three millimeters to approximately fifteen millimeters.

3. The deflection yoke according to claim 1, wherein each of the openings has a base that lies on the disposition angle.

4. The deflection yoke according to claim 3, wherein each of the openings has a substantially triangular shape.

5. The deflection yoke according to claim 3, wherein each of the openings has a substantially trapezoidal shape.

6. The deflection yoke according to claim 3, wherein each of the openings has a substantially semicircular shape.

7. A device for self-correcting mis-convergence of electron beams of a color cathode ray tube comprising:

a) a horizontal coil including a neck bend section and a front bend section, said neck bend section having a winding distribution being symmetric about a horizontal axis; and b) means for simultaneously correcting XH and HCR misconvergence, said correcting means being disposed in the neck bend section and creating a XH-HCR misconvergence curve for the device that passes through the origin.

8. The device according to claim 7, wherein the correcting means includes a pair of openings in the winding distribution of the horizontal coil.

9. The device according to claim 8, wherein each of the openings is disposed at a disposition angle relative to the horizontal axis through the neck bend section of approximately ten degrees.

10. The device according to claim 9, wherein each of the openings is disposed at a predetermined distance from a center of the neck bend section.

11. The device according to claim 10, wherein the predetermined distance falls within a range from approximately three millimeters to approximately fifteen millimeters.

12. The device according to claim 9, wherein each of the openings has a base that lies on the disposition angle.

13. The device according to claim 12, wherein each of the openings has a substantially triangular shape.

14. The device according to claim 12, wherein each of the openings has a substantially trapezoidal shape.

15. The device according to claim 12, wherein each of the openings has a substantially semicircular shape.

* * * * *